US005553592A

United States Patent [19]

Bäuerle et al.

[11] Patent Number: 5,553,592

[45] Date of Patent: Sep. 10, 1996

[54] FUEL INJECTION ARRANGEMENT FOR A MULTICYLINDER INTERNAL COMBUSTION ENGINE

[75] Inventors: Emil Bäuerle, Esslingen; Magnus Korte, Leonberg, both of Germany

[73] Assignee: Mercedes-Benz AG, Stuttgart, Germany

[21] Appl. No.: 512,536

[22] Filed: Aug. 8, 1995

[30] Foreign Application Priority Data

Sep. 29, 1994 [DE] Germany ..... 44 34 783.9

[51] Int. Cl.[6] ..... F02M 41/00

[52] U.S. Cl. ..... 123/456; 123/90.36; 123/508

[58] Field of Search ..... 123/456, 468, 123/469, 507, 508, 90.36, 90.13, 90.39

[56] References Cited

U.S. PATENT DOCUMENTS

| | | | |
|---|---|---|---|
| 2,104,729 | 1/1938 | Bijur | 123/90.36 |
| 2,955,582 | 10/1960 | Taylor | 123/508 |
| 3,125,078 | 3/1964 | Reimers | 123/468 |
| 4,058,091 | 11/1977 | Tanahashi | 123/507 |
| 4,538,561 | 9/1985 | Amemori | 123/508 |
| 4,721,075 | 1/1988 | Kasai | 123/508 |
| 5,237,968 | 8/1993 | Miller | 123/508 |
| 5,237,976 | 8/1993 | Lawrence | 123/508 |
| 5,297,523 | 3/1994 | Hafner et al. . | |
| 5,299,540 | 4/1994 | Fransson | 123/468 |
| 5,325,834 | 7/1994 | Ballheimer | 123/456 |
| 5,476,075 | 12/1995 | Doll | 123/90.36 |

FOREIGN PATENT DOCUMENTS

| | | | |
|---|---|---|---|
| 0259106 | 3/1988 | European Pat. Off. . | |
| 0501459 | 9/1992 | European Pat. Off. . | |
| 4404378 | 8/1994 | Germany . | |
| 0117142 | 10/1978 | Japan | 123/90.36 |
| 225034 | 12/1942 | Switzerland | 123/90.13 |
| 1469480 | 10/1923 | United Kingdom | 123/90.36 |

*Primary Examiner*—Carl S. Miller
*Attorney, Agent, or Firm*—Klaus J. Bach

[57] ABSTRACT

In a fuel injection arrangement for a multicylinder internal combustion engine having inlet and exhaust valves operated by rocker arms pivotally supported on a hollow rocker arm support shaft, fuel is supplied from a high pressure fuel pump to fuel injectors mounted on the cylinders through a distribution system which includes a pump discharge line connected to the hollow rocker arm support shaft and distribution lines extending from the rocker arm support shaft to the injectors.

3 Claims, 1 Drawing Sheet

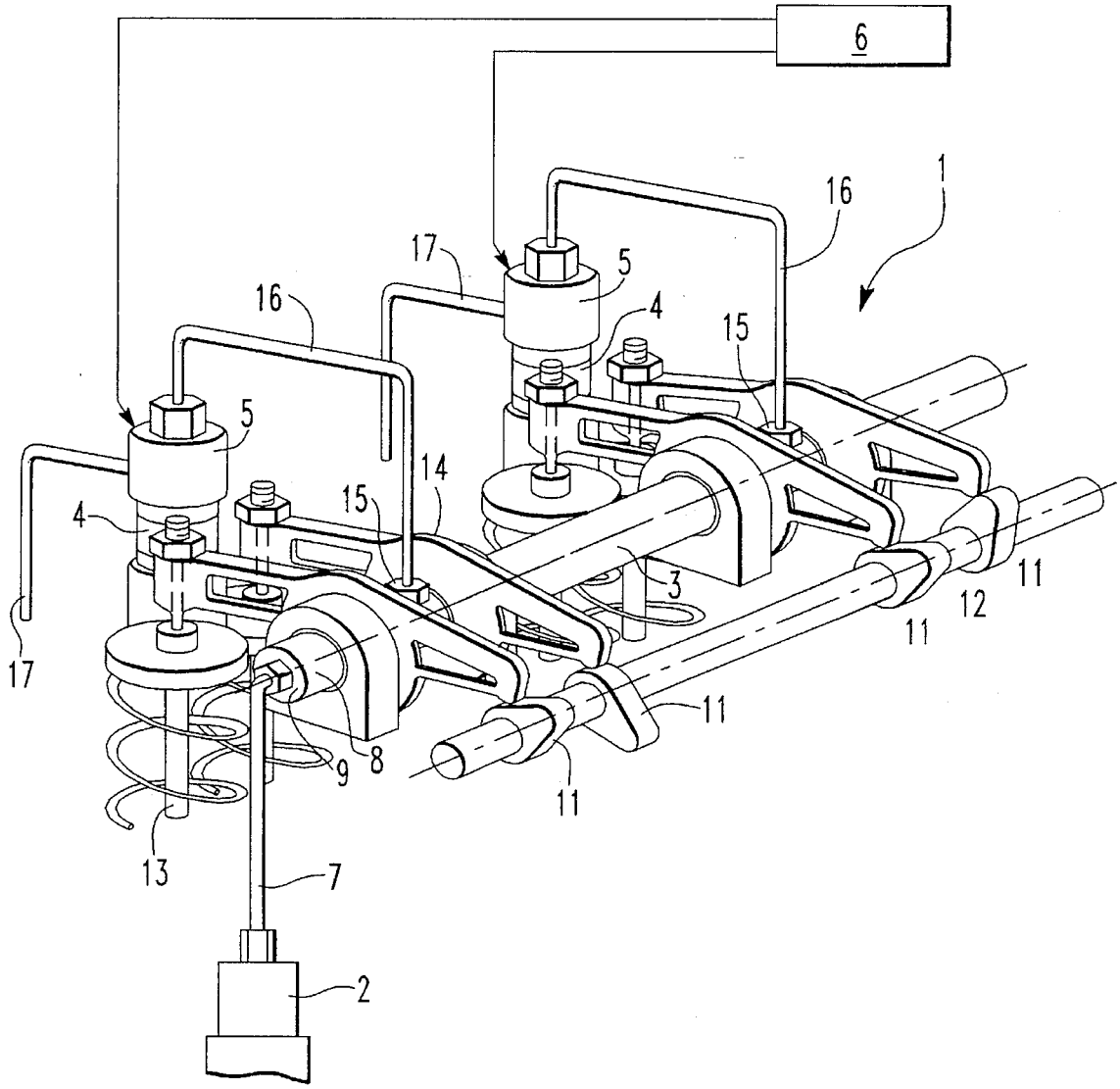
6
1
16
17
5
4
15
16
5
14
15
4
3
11
12
11
17
11
9
8
11
13
7
2

FUEL INJECTION ARRANGEMENT FOR A MULTICYLINDER INTERNAL COMBUSTION ENGINE

BACKGROUND OF THE INVENTION

The invention concerns a fuel injection arrangement for a multicylinder internal combustion engine.

EP 0 501 459 discloses a fuel injection arrangement wherein a high pressure pump delivers fuel to a reservoir acting as a common fuel supply conduit (common rail). The common rail is a high-strength, thick-walled tube and is connected to electronically operated injection nozzles via injector lines.

It is the object of the current invention to improve the fuel injection arrangement between the high pressure pump and the electromagnetically operated nozzles with respect to weight and cost.

SUMMARY OF THE INVENTION

In a fuel injection arrangement for a multicylinder internal combustion engine having intake and exhaust valves operated by rocker arms pivotally supported on a hollow rocker arm support shaft, fuel is supplied from a high pressure fuel pump to the injectors mounted on the cylinders through a distribution system which includes a pump discharge line connected to the hollow rocker arm support shaft and distribution lines extending from the rocker arm support shaft to the various injectors.

Due to special arrangement of the rocker arm shaft, the hollow shaft can function simultaneously as a reservoir in a fuel supply system, thereby eliminating an otherwise separate supply line.

In addition to providing for more available in space, weight and cost are minimized. Also, the injection lines from the rocker arm support shaft to the injection nozzles are relatively short.

BRIEF DESCRIPTIONS OF THE DRAWINGS

The sole FIGURE shows a fuel supply arrangement for a diesel internal combustion engine.

DESCRIPTION OF A PREFERRED EMBODIMENT

A fuel injection arrangement 1 for an internal combustion engine consists essentially of at least a high pressure pump 2 for pumping fuel, a high-pressure fuel reservoir which serves as a supply conduit 3 (common rail) and electromagnetically operated fuel injection nozzles 4 including electromagnets 5 which are activated by a control unit 6 depending on the engine operating parameters.

The high pressure fuel pump 2 has a fuel discharge line 7 which is attached to a hollow rocker arm shaft 8 serving simultaneously as a common fuel supply conduit 3 for supplying fuel to the electromagnetically operated injection nozzles 4.

The fuel discharge line 7 is attached to a free end 9 of the rocker arm support shaft 8. The rocker arms 14 are pivotally supported on the rocker arm shaft 8 and are actuated by cams 11 on a camshaft 12 disposed at one end of the rocker arms 14, while operating the intake and exhaust valves 13 at their other their ends. Injection lines 16 leading to corresponding fuel injection nozzles 4 are connected to the rocker arm support shaft 8 preferably between intake and exhaust valves 13, 14 of their respective cylinders (not shown). Return lines 17 extend from the injection nozzles 4 for returning fuel to a fuel tank.

What is claimed:

1. A fuel injection arrangement for a multicylinder internal combustion engine having for each cylinder intake and exhaust valves, a rocker arm support shaft, rocker arms pivotally mounted on said rocker arm support shaft for operating said intake and exhaust valves, electromagnetically operable injectors mounted on said cylinders for supplying fuel to said cylinders, and a high pressure fuel supply system for supplying fuel under pressure to said fuel injectors, said fuel supply system comprising said rocker arm support shaft which is hollow and serves as a fuel distribution conduit, a high pressure fuel pump having a fuel discharge line connected to said rocker arm support shaft and fuel distribution lines extending from said rocker arm support shaft to said injectors.

2. A fuel injection system according to claim 1, wherein a fuel distribution line is connected to said rocker arm support shaft between each set of intake and exhaust valves.

3. A fuel injection system according to claim 1, wherein said fuel discharge line extending from said high pressure pump is connected to one end of said rocker arm support shaft.

* * * * *